US011359363B1

(12) United States Patent
Brotherton

(10) Patent No.: US 11,359,363 B1
(45) Date of Patent: Jun. 14, 2022

(54) MODULAR BUILDING SYSTEM AND METHOD OF USE

(71) Applicant: Greg Brotherton, Los Angeles, CA (US)

(72) Inventor: Greg Brotherton, Los Angeles, CA (US)

( * ) Notice: Subject to any disclaimer, the term of this patent is extended or adjusted under 35 U.S.C. 154(b) by 22 days.

(21) Appl. No.: 16/937,436

(22) Filed: Jul. 23, 2020

(51) Int. Cl.

| | |
|---|---|
| ***E04B 1/02*** | (2006.01) |
| ***E04B 2/18*** | (2006.01) |
| ***E04C 1/40*** | (2006.01) |
| *E04B 2/02* | (2006.01) |

(52) U.S. Cl.
CPC ..... *E04B 1/02* (2013.01); *E04B 2/18* (2013.01); *E04C 1/40* (2013.01); *E04B 2002/0206* (2013.01)

(58) Field of Classification Search
CPC ..... E04B 1/02; E04B 2/18; E04B 2002/0206; E04C 1/40; E04C 3/122; B32B 21/13
See application file for complete search history.

(56) References Cited

U.S. PATENT DOCUMENTS 2,691,242 A * 10/1954 Young ..... A63H 33/082 446/115
3,410,441 A * 11/1968 Rhyne ..... A47B 88/941 220/4.28
3,591,212 A * 7/1971 Rhyne ..... F16B 12/46 217/65
3,692,201 A * 9/1972 Garduna ..... B65D 9/12 217/12 R
4,173,287 A * 11/1979 Kumakawa ..... B65D 9/12 217/65
4,782,972 A * 11/1988 Wenkman ..... B42F 7/10 220/4.28
4,914,874 A * 4/1990 Graham, Jr. ..... B65D 9/32 52/79.1
5,215,490 A * 6/1993 Szoradi ..... A63H 33/08 446/115
5,746,038 A * 5/1998 Houk ..... E04B 1/02 446/116
6,189,271 B1 * 2/2001 Christensen ..... E04B 2/702 446/106
6,453,973 B1 * 9/2002 Russo ..... A47B 47/0075 160/135
2004/0074189 A1 * 4/2004 Deschenes ..... B27M 3/006 52/589.1
2008/0280523 A1 * 11/2008 Bishop ..... A63H 33/082 446/124

* cited by examiner

*Primary Examiner* — Babajide A Demuren
(74) *Attorney, Agent, or Firm* — Leavitt Eldredge Law Firm

(57) ABSTRACT

A modular building system consists of panels of various sizes and shapes that join together through a series of primary joints and secondary joints. The primary joint and secondary joint have key-to-keyway fasteners and wedge-to-slot fasteners. In this way any panel can attach to any other panel. Panels could be joined for form larger panels and cutouts or other features could be included in the panels.

2 Claims, 6 Drawing Sheets

MODULAR BUILDING SYSTEM AND METHOD OF USE

BACKGROUND

1. Field of the Invention

The present invention relates generally to building systems, and more specifically, to a modular building system for the rapid and precise creation of structures where the parts are joined together to create three-dimensional shapes.

2. Description of Related Art

Building systems are well known in the art and are effective means construct buildings, walls and other structures. Commonly, buildings are created by the cutting of structural parts such as beams and blocks that are then bolted, welded, stacked or otherwise joined together. For example, a conventional warehouse is made from steel beams that are cut to the proper length and are bolted to a pad and them welded to form arches upon which a roof is placed. The walls are closed off and doors put in them. Electrical and plumbing are then added through pipes and conduits.

One of the problems commonly associated with common building systems is its limited efficiency. For example, a building must be designed and then the parts ordered. When the parts have been fabricated, shipped and prepared for assembly they must be rigorously joined together. If any changes have been requested to the design the parts must be altered and reordered. This causes delays in the construction and restricts the flexibility of the design.

Additionally, once the building is complete, any changes or expansions require unique building-specific plans and parts to accomplish the work.

Accordingly, although great strides have been made in the area of building systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
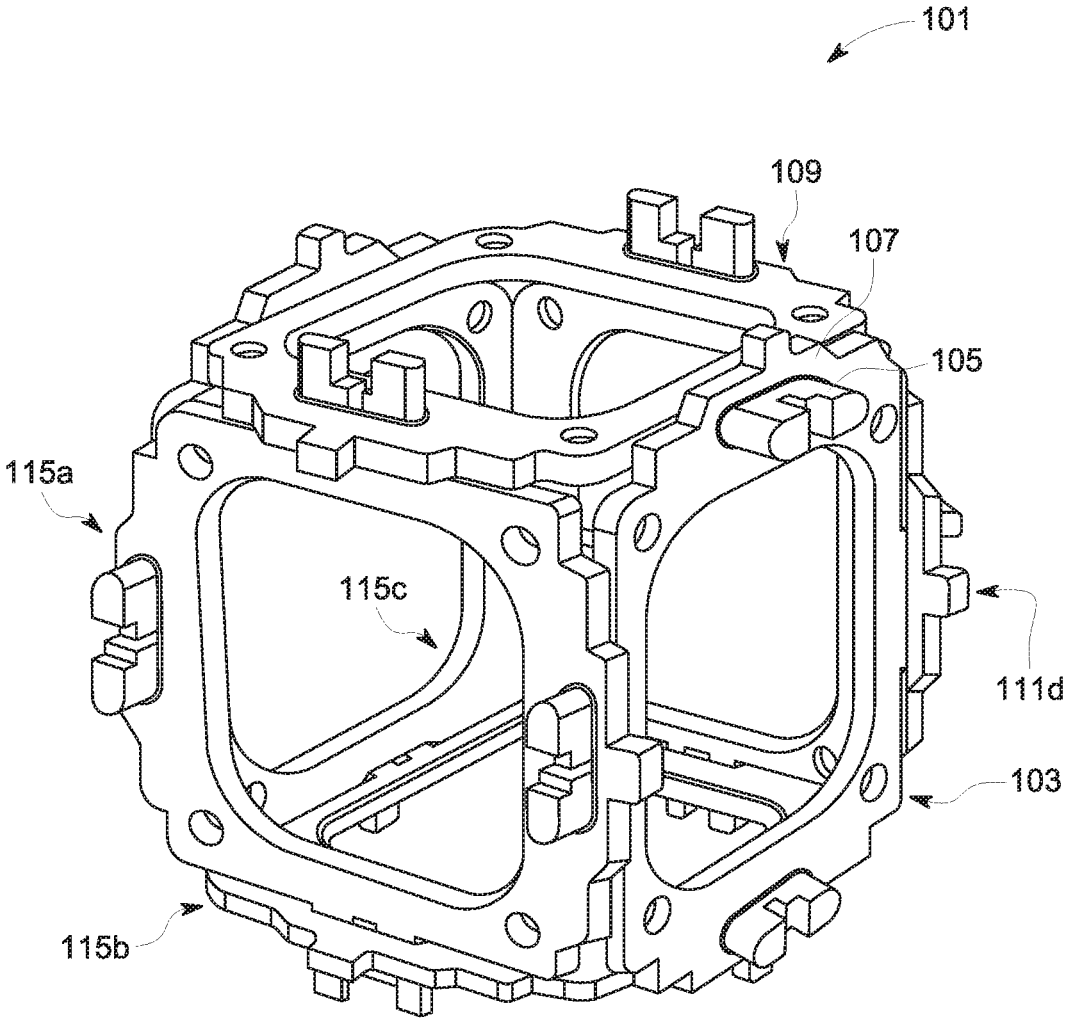
FIG. 1 is a perspective view of a modular building system in accordance with a preferred embodiment of the present application.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional building systems. Specifically, the present invention provides means rapidly and repeatably assembling a building or other structure. Additionally, the invention allows for modification to the building or structure without unique or special planning or parts. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein like reference characters identify corresponding or similar elements throughout the several views, FIG. 1 depicts a perspective view of a modular building system in accordance with a preferred embodiment of the present application. It will be appreciated that system 101 overcomes one or more of the above-listed problems commonly associated with conventional building systems.

In the contemplated embodiment, system 101 includes a first panel 103 removably attached to a second panel 109 through a primary joint 105. Subsequent panels 111 are similarly attached to form a cube. Each panel also includes a secondary joint 107.

Figure 2:
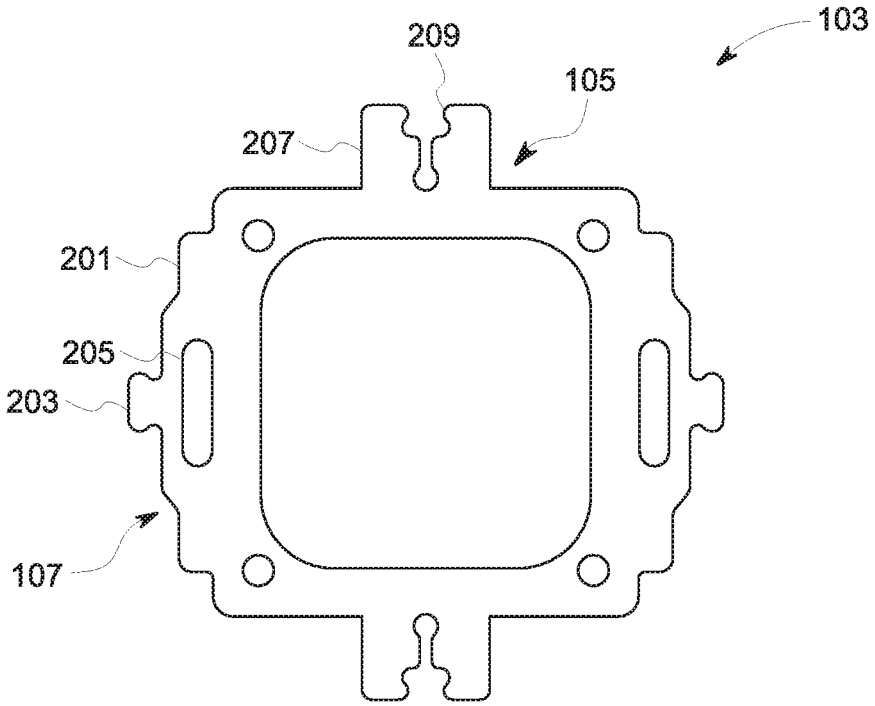
FIG. 2 is a front view of a panel of the system of FIG. 1.

The panel 103 further depicted by FIG. 2 includes a body 201 to which the primary joint 105 and secondary joint 107 extend therefrom. The primary joint 105 includes a wedge 207 at the end thereof is a keyway 209. The secondary joint 107 includes a key 203 and a passageway 205. The passageway 205 extends through the body 201 and is configured to accept the wedge 207 therein. The key 203 is configured to enter and rest in the keyway 209.

Figure 3:
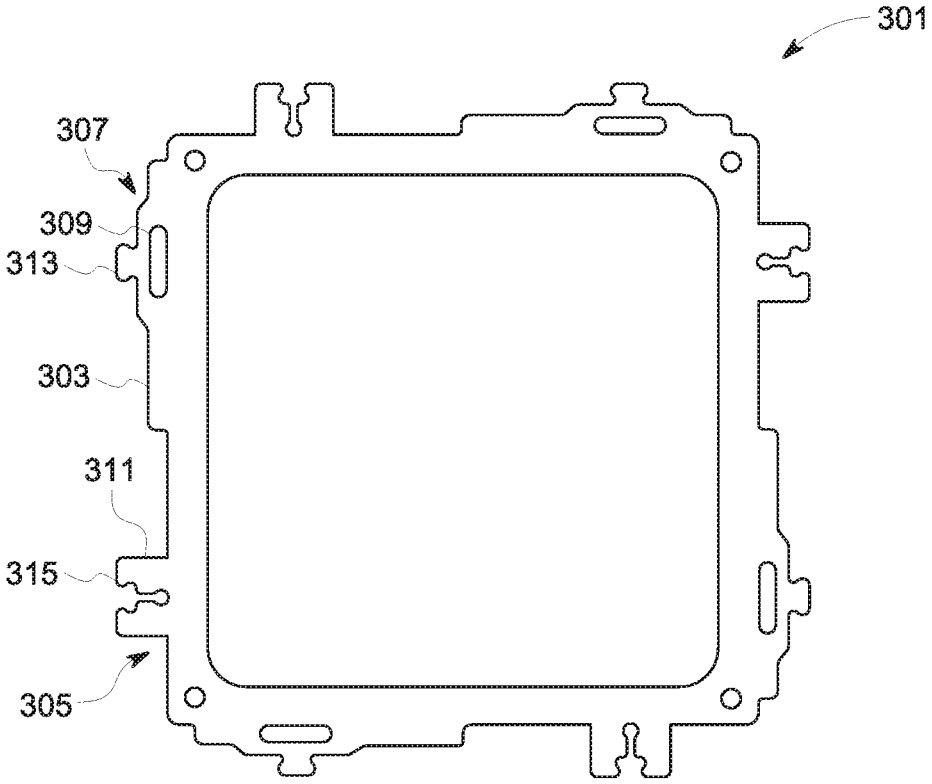
FIG. 3 is a front view of an alternative embodiment of the panel of FIG. 2.
Figure 4:
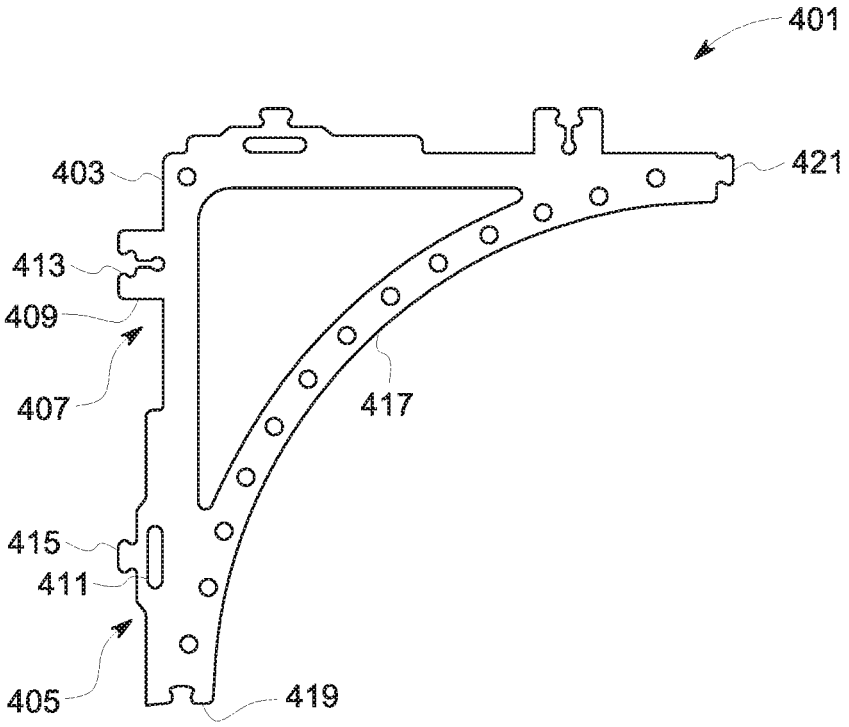
FIG. 4 is a front view of an alternative embodiment of the panel of FIG. 2.
Figure 5:
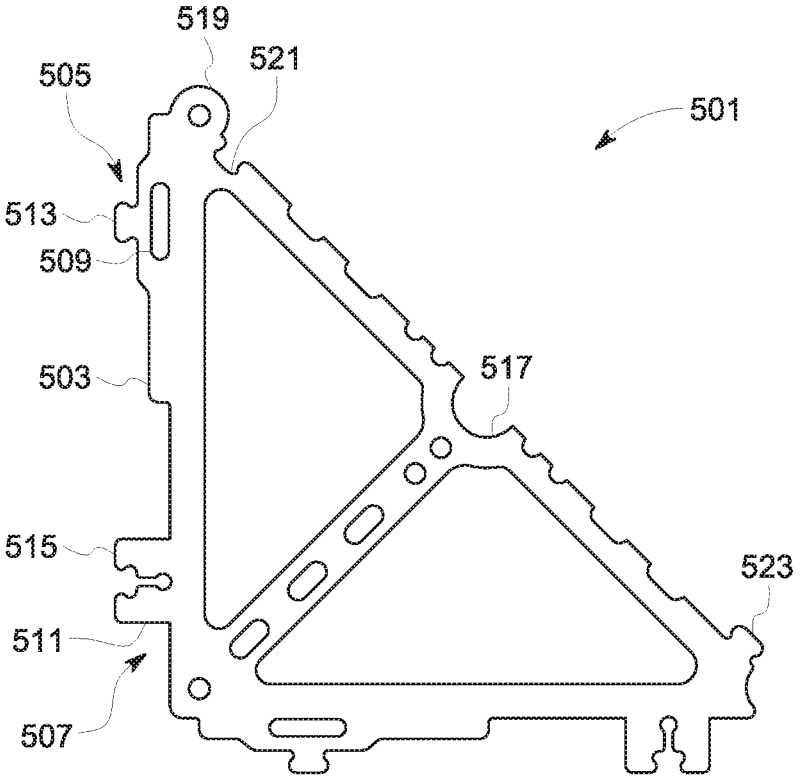
FIG. 5 is a front view of an alternative embodiment of the panel of FIG. 2.

The panel 103 is the primary embodiment of the system 101 however, other embodiments are contemplated and are depicted by FIGS. 3, 4, and 5 so that is should be understood that any configuration of panels is contemplated so long as it includes a primary joint and secondary joint on the same body. It will also be understood that the number of primary joints and secondary joints on the body will vary from one embodiment to another.

Embodiment 301 includes a body 303 where the primary joint 305 and secondary joint 307 are both attached to the body 303 along the same edge. The primary joint 305 includes a wedge 311 at the end thereof is a keyway 315. The secondary joint 307 includes a key 313 and a passageway 309. The passageway 309 extends through the body 301 and is configured to accept the wedge 311 therein. The key 313 is configured to enter and rest in the keyway 315.

Embodiment 401 is similar to embodiment 301 wherein the body 403 is a portion of the body 303 likewise it includes a primary joint 407 and secondary joint 405 that are both attached to the body 403 along the same edge. The body 403 includes a plug 421 at one end and a receptacle 419 at another. It is contemplated that the plug 421 and receptacle 419 are configured to allow multiple panels 401 to be joined together to form a larger panel. The body 403 includes an inner brace 417 that adds stability to the body 403 and it is contemplated that when four panels 401 are joined that the inner braces 417 will form a circle therebetween.

Also, the primary joint 407 includes a wedge 409 at the end thereof is a keyway 413. The secondary joint 405 includes a key 415 and a passageway 411. The passageway 411 extends through the body 401 and is configured to accept the wedge 409 therein. The key 415 is configured to enter and rest in the keyway 413.

Embodiment 501 is similar to embodiment 401 in that multiple panels are contemplated to be joined together to form a unified panel. The embodiment 501 includes a body 503 where the primary joint 507 and secondary joint 505 are both attached to the body 503 along the same edge.

Embodiment 501 also includes an inner brace 517 that adds stability to the body 503 and it is contemplated that when two panels 501 are joined that the inner braces 517 will form a small central circle therebetween. The body 501 further includes a plug 523 at one end and a receptacle 521 at another. It is contemplated that the plug 523 and receptacle 521 are configured to allow two panels 501 to be joined together to form a larger panel. The body 501 also includes an eyelet 519 at one end that is configured to nest with the body 501 at the other end.

The primary joint 507 includes a wedge 511 at the end thereof is a keyway 515. The secondary joint 505 includes a key 513 and a passageway 509. The passageway 509 extends through the body 501 and is configured to accept the wedge 511 therein. The key 513 is configured to enter and rest in the keyway 515.

Figure 6:
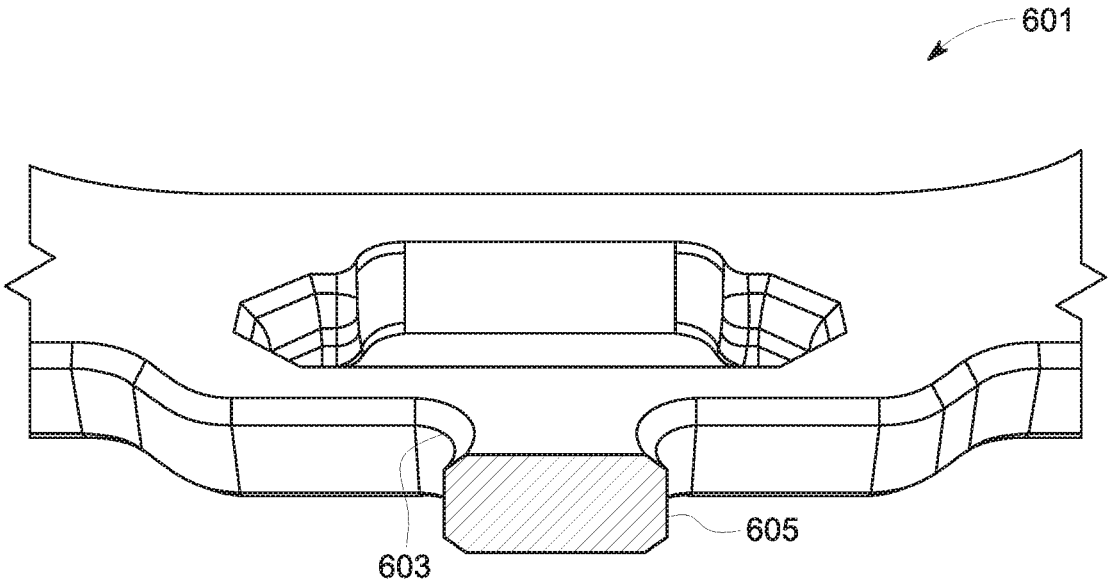
FIG. 6 is a cross-sectional side top view of the secondary joint of the panel of FIG. 2.
Figure 7:
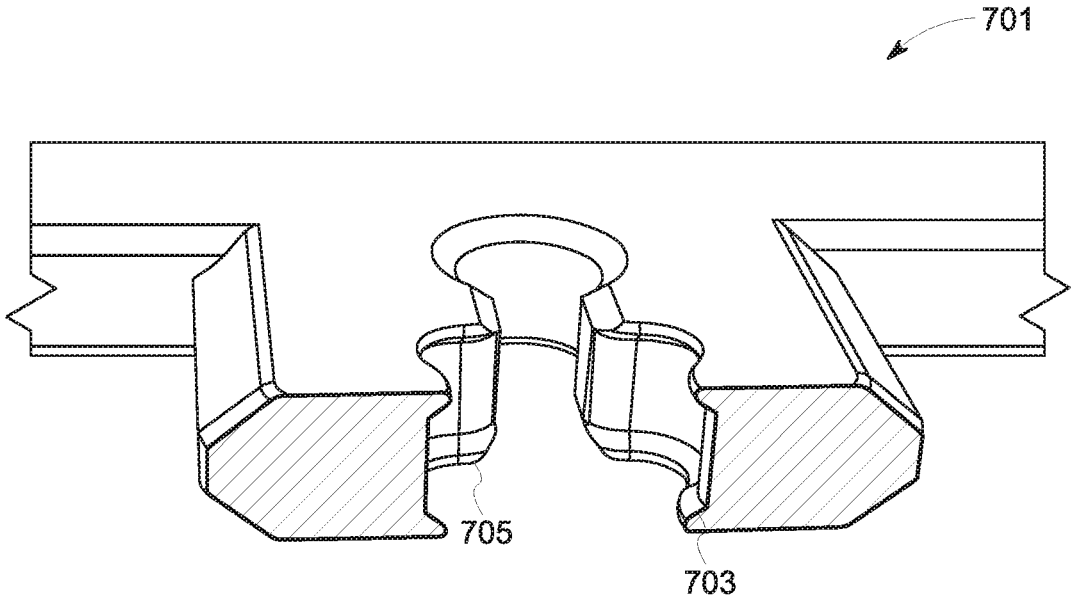
FIG. 7 is a cross-sectional side top view of the primary joint of the panel of FIG. 2.

Referring now to FIGS. 6 and 7 a key 601 and keyway 701 are depicted for clarity. It will be understood that the top 605 of the key 601 is wider than the base 603 so that when the key 603 enters a keyway that it is retained there by the smaller size of the base 607. The keyway 701 includes an opening 703 that is narrower than the interstitial space 705 therein and is configured to hold the key 601 therein.

It should be appreciated that one of the unique features believed characteristic of the present application is that the first panel has a primary joint 105 that allows it to be connected to the secondary joint 107 of the second panel 109 and that in this manner additional panels are joined to form a structure.

Figure 8:
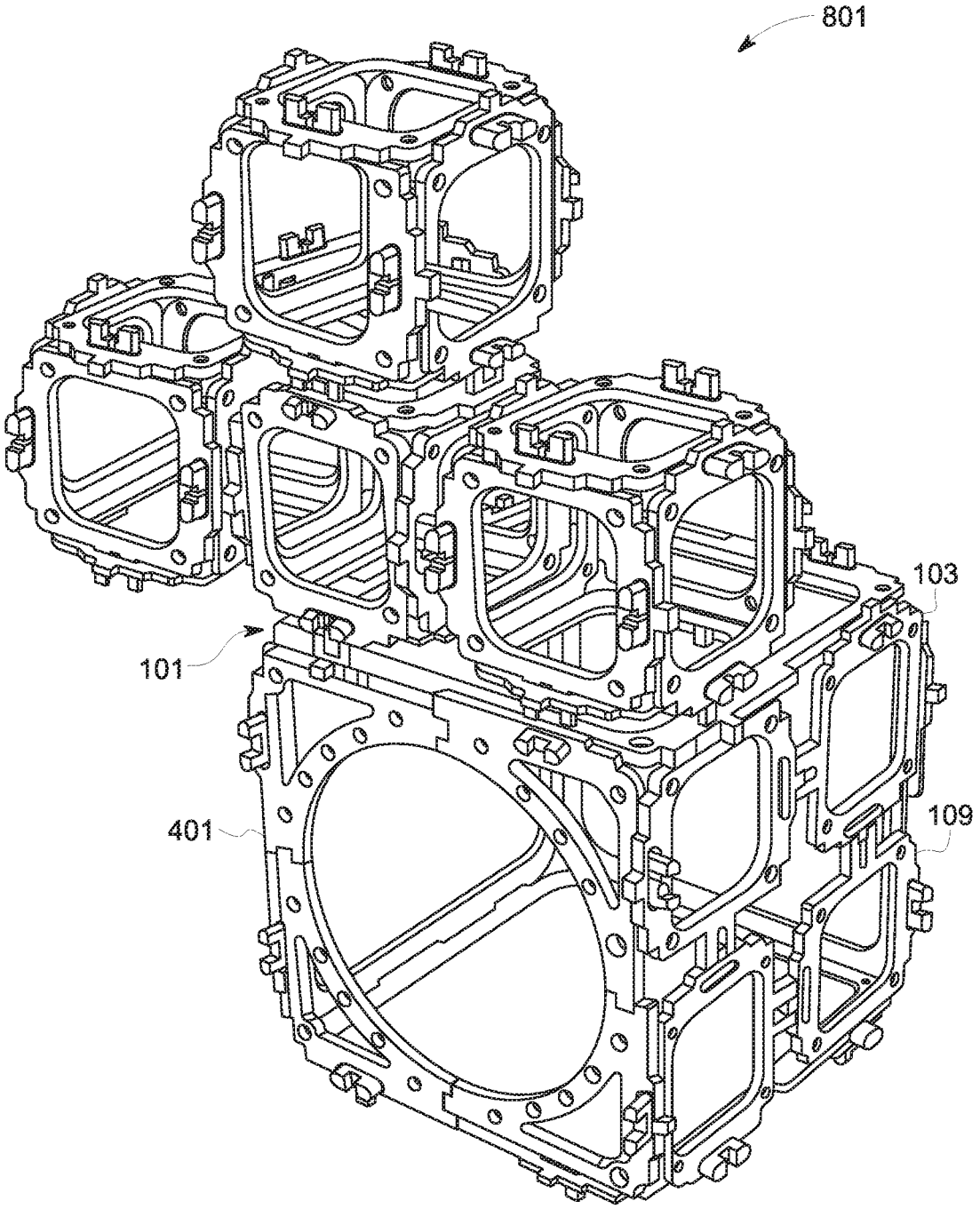
FIG. 8 is a perspective view of an assembly of the system of FIG. 1.

It will be further appreciated that the panels from all of the embodiments are able to be connected to each other as depicted by FIG. 8 where the first panel 103, second panel 109, panel 301 and panel 401 are combined to form the structure 801. It will be further appreciated that the first panel 103 is configured to be half the size of panel 301 to accommodate the efficient construction of the structure. It will further be appreciated that the large circle formed by panels 401 provides access to the interior of the large cube.

Figure 9:
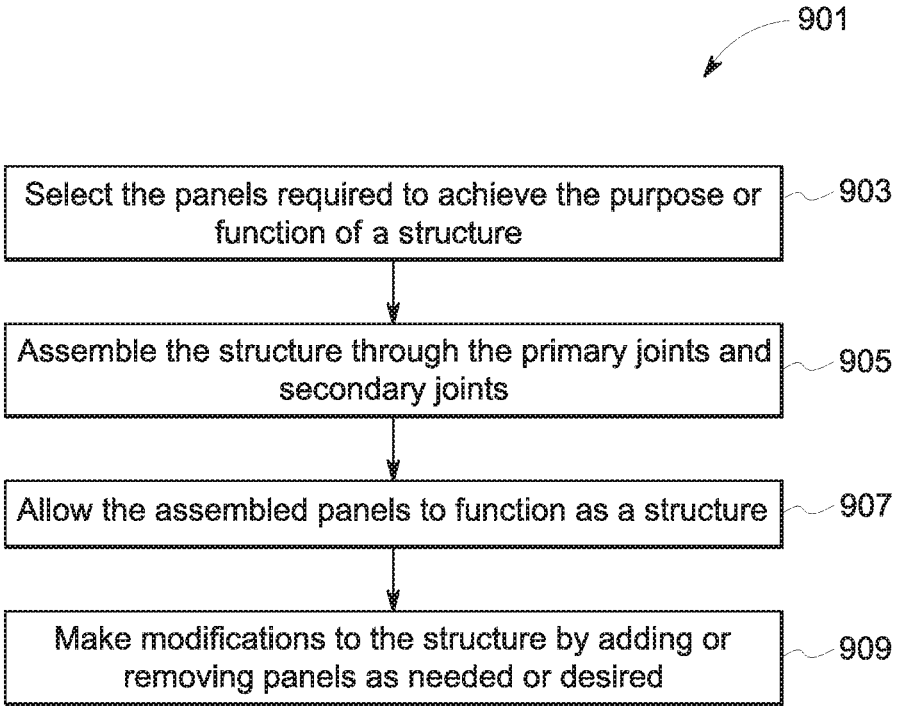
FIG. 9 is a flowchart of a method of assembling a structure.

Referring now to FIG. 9 a method of assembling a structure is depicted. Method 901 includes selecting the panels required to achieve the purpose or function of a structure 903, assemble the structure through the primary joints and secondary joints 905, allowing the assembled panels to function as a structure 907 and making modifications to the structure by adding or removing panels as needed or desired 909.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed:

1. A modular building system comprising;

a first panel, the first panel having:

a body extending from a first side to a second side and from a third side to a fourth side;

a first primary joint extending from the first side of the body, the first primary joint having a wedge protruding from the first side of the body, the wedge having a keyway cut therefrom;

a first secondary joint extending from the third side to the body, the secondary joint having a passageway extending through a thickness of the body from a front surface to a back surface and the secondary joint further having a key protruding from the third side of the body;

a second panel, the second panel having a second primary joint and a second secondary joint;

wherein the second primary joint is configured to engage with first secondary joint; and wherein the second secondary joint is configured to engage with the first primary joint;

wherein the first panel and second panel are secured together; and wherein a structure is formed by joining the first panel to the second panel.

2. A method of assembling a structure comprising:

providing the system of claim 1;

securing the first panel to the second panel;

securing one or more additional panels to the first panel and the second panel;

assembling the structure through the engagement of the first panel, the second panel, and the one or more additional panels;

allowing the assembled panels to function as a structure; and making modifications to the structure by adding or removing panels as needed or desired.

* * * * *